US005560047A

United States Patent [19]

Shimada

[11] Patent Number: 5,560,047

[45] Date of Patent: Oct. 1, 1996

[54] SWIMMING INSTRUMENT

[75] Inventor: Mitsuo Shimada, Tokyo, Japan

[73] Assignee: Kernel Technical Ability Corp., Tokyo, Japan

[21] Appl. No.: 525,043

[22] Filed: Sep. 8, 1995

[30] Foreign Application Priority Data

Oct. 4, 1994 [JP] Japan ..... 6-240275

[51] Int. Cl.[6] ..... A61F 9/02; A42B 1/12

[52] U.S. Cl. ..... 2/428; 2/68

[58] Field of Search ..... 2/428, 430, 68, 2/429, 10, 442, 2.15

[56] References Cited

U.S. PATENT DOCUMENTS

| | | | |
|---|---|---|---|
| 2,799,020 | 7/1957 | Currie | 2/428 |
| 4,279,039 | 7/1981 | Drew | 2/428 |
| 4,689,837 | 9/1987 | Bolle | 2/428 X |

*Primary Examiner*—Peter Nerbun

*Attorney, Agent, or Firm*—Rothwell, Figg, Ernst & Kurz, P.C.

[57] ABSTRACT

A swimming instrument having a simple structure which is capable of preventing the positional shift and water leakage of swimming goggles due to an impulsive water pressure during a swimming race is disclosed. It comprises: swimming goggles including a pair of right and left water-proof goggle frame portions each of which is formed in a tapered cylinder shape, and lens portions each formed integrally with the water-proof goggle frame portions; and a swimming cap having leading edges each caught by the swimming goggles; wherein the swimming goggles further comprises catching ribs for catching the leading edges of the swimming cap, which are each formed integrally with the surfaces of the water-proof goggle frame portions at positions higher than those of the lens portions; and the leading edge of the swimming cap is formed in a shape corresponding to that of the catching rib.

11 Claims, 2 Drawing Sheets

SWIMMING INSTRUMENT

BACKGROUND OF THE INVENTION

1. Field of the Invention

The present invention relates to a swimming instrument including swimming goggles in combination with a swimming cap, which is suitably used for swimming race.

2. Description of the Related Art

Prior art swimming goggles for swimming race are of a type which includes right and left goggle frame portions made of synthetic resin, lens portions formed integrally with the goggle frame portions, a nose crossing band for connecting the goggle frame portions to each other, and a fastening band mounted to the goggle frame portions. In the swimming goggles of this type, even when used in combination with a swimming cap, the swimming goggles are put on the face of a swimmer separately from the swimming cap fitted on the head of the swimmer.

The prior art swimming goggles having a simple construction including goggle frame portions integrated with lens portions are, as described above, used separately from a swimming cap, and accordingly, for example, during swimming race, the swimming goggles are singly applied with a large impulsive water pressure, and further since any measure for the impulsive water pressure is not taken into account, there arises a problem in causing the positional shift of the swimming goggles or permeation of water in the swimming goggles (water leakage), thus leading to an inconvenience in swimming race.

SUMMARY OF THE INVENTION

In view of the foregoing, the present invention has been made, and an object of the present invention is to provide a swimming instrument with a simple structure including swimming goggles used in combination with a swimming cap, which is capable of eliminating a fear of positional shift of the swimming goggles and permeation of water in the swimming goggles (water leakage) due to an impulsive water pressure during swimming race.

To solve the above object, according to a preferred mode of the present invention, there is provided a swimming instrument comprising:

swimming goggles including a pair of right and left water-proof goggle frame portions each of which is formed in a tapered cylinder shape, and lens portions each formed integrally with the water-proof goggle frame portions; and a swimming cap having leading edges each caught by the swimming goggles;

wherein the swimming goggles further comprises catching ribs for catching the leading edges of the swimming cap, which are each formed integrally with the surfaces of the water-proof goggle frame portions at positions higher than those of the lens portions; and the leading edge of the swimming cap is formed in a shape corresponding to that of the catching rib.

Each of the catching ribs of the swimming goggles may be formed in a visor shape inclined downward along the taper surface of the water-proof goggle frame portion with its base portion connected to the upper portion on the surface of the water-proof goggle frame portion.

Each of the catching ribs may be also formed in such a manner as to be elastically deformed in the direction where the leading edge of the swimming cap is pressed between the water-proof goggle frame portion and the same by an impulsive water pressure.

The leading edge of the swimming cap may be formed in such a circular sectional shape or thick-wall sectional shape as to be elastically engaged with a groove formed between the upper surface of the water-proof goggle frame portion and the catching rib.

In the swimming instrument of the present invention, since catching ribs are formed integrally with the upper portions on the surfaces of water-proof goggle frame portions, the swimming goggles can be used in combination with a swimming cap in such a manner as to be integrally joined thereto only by catching leading edges of the swimming cap on the catching ribs. As a result, it becomes possible to absorb and disperse an impulsive water pressure applied to the swimming goggles during swimming race by the swimming cap, and hence to certainly prevent the positional shift and water leakage of the swimming goggles due to the impulsive water pressure.

The above and other features and advantages of the present invention will becomes apparent from the following description which will be given with reference to the illustrative accompanying drawings.

DETAILED DESCRIPTION OF THE PREFERRED EMBODIMENTS

Hereinafter, preferred embodiments of the present invention will be described with reference to the drawings.

Embodiment 1

Figure 1:
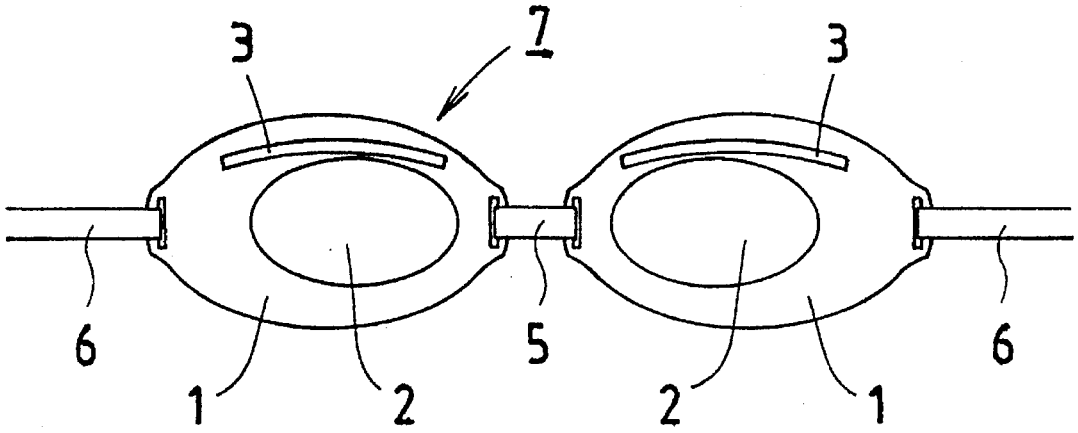
FIG. 1 is a front view of swimming goggles of one embodiment of a swimming instrument according to the present invention.
Figure 2:
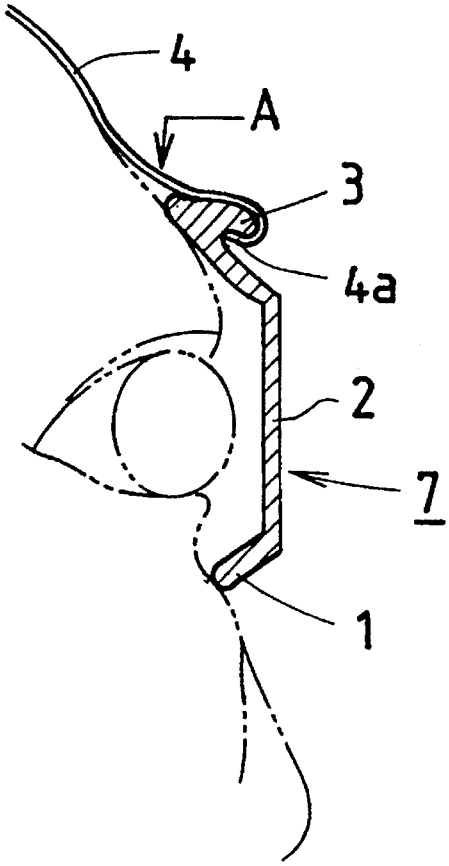
FIG. 2 is a sectional view showing the state that the swimming goggles shown in FIG. 1 are used in combination with a swimming cap.
Figure 3:
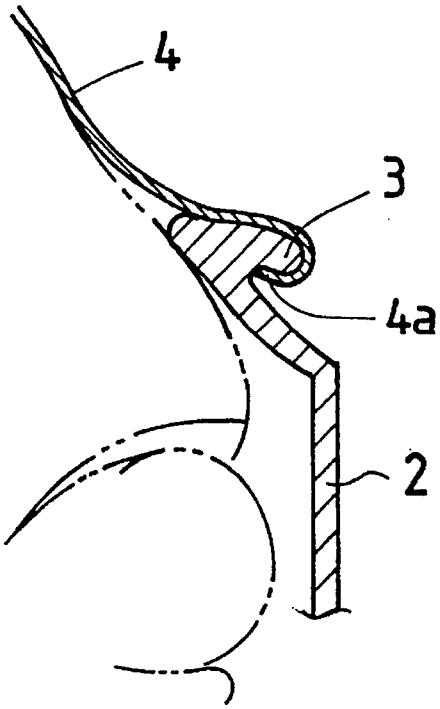
FIG. 3 is an enlarged sectional view of FIG. 2.

Referring to FIGS. 1 to 3, swimming goggles of a swimming instrument include a pair of right and left water-proof goggle frame portions 1, which are generally made of a synthetic resin such as acrylic acid resin; lens portions 2 made of a synthetic resin which are formed integrally with the water-proof goggle frame portions 1; and catching ribs 3 for catching leading edges of a swimming cap 4, which are respectively formed on the surfaces of the water-proof goggle frame portions 1 at the positions higher than those of the lens portions 2.

More specifically, each water-proof goggle frame portion 1 is integrally formed in a tapered cylinder shape gradually extended from the peripheral portion of the lens portion 2 integrated therewith to the user's face side (around the eyeball). As shown in FIGS. 2 and 3, the catching rib 3 is integrally formed in a visor shape inclined downward with its base portion connected to the upper portion on the surface of the water-proof goggle frame portion 1. The catching rib 3 thus formed is effective to suppress the resistance of water during swimming race because it is inclined along the upper taper surface of the water-proof goggle frame 1.

On the other hand, the swimming cap 4 is generally made of rubber, and it has leading edges 4*a* each of which is removably caught by the catching rib 3 of the waterproof frame portion 1.

In these figures, reference numeral 5 indicates a nose crossing band made of rubber which is adapted to connect the right and left water-proof goggle frame portions 1 to each other; and reference numeral 6 indicates a fastening band made of rubber which is mounted to both sides of the water-proof goggle frame portions 1. The swimming goggles 7 are composed of the water-proof goggle frame portions 1 having the catching ribs 3, lens portions 2, nose crossing band 5 and fastening band 6.

Next, the function of the present invention will be described.

The swimming goggles 7 having the above-described construction are used in combination with the swimming cap 4. At this time, as shown in FIGS. 2 and 3, the leading edges 4*a* of the swimming cap 4 are each caught by the catching ribs 3 of the water-proof goggle frame portions 1. The upper portions of the water-proof goggle frame portions 1 are thus integrally joined to the swimming cap 4 fitted on the head of the swimmer, and the water-proof goggle frame portions i are fixedly pressed on the forehead of the swimmer in such a manner that the upper edges including the catching ribs 3 are covered with the swimming cap 4.

Incidentally, during swimming race, the forehead and the head of a swimmer putting on a swimming goggles are applied with a large impulsive water pressure. At this time, the prior art swimming goggles sometimes cause the positional shift and water leakage.

In the swimming goggles 7 of the swimming instrument according to the present invention, however, the upper edges of the water-proof goggle frame portions 1 are covered with the swimming cap 4 as described above, and further the leading edges 4*a* of the swimming cap 4 are caught by the catching ribs 3 of the water-proof goggles frame portions 1, and accordingly, the above-described impulsive water pressure is applied to the swimming cap 4 covering the forehead of the swimmer as shown by the arrow A of FIG. 2, so that the upper edges of the water-proof goggle frame portions 1 are fixedly pushed on the forehead of the swimmer through the swimming cap 4 by the impulsive water pressure. Consequently the swimming goggles 7 do not cause the positional shaft and water leakage due to the impulsive water pressure.

Embodiment 2

In the above-described embodiment, the leading edges 4*a* of the swimming cap 4 are caught by the catching ribs 3 of the water-proof goggle frame portions 1; however, each of the leading edges 4a may be formed in a circular sectional shape or thick-wall sectional shape. In this case, each leading edge 4*a* may be press-fitted in a groove formed between the upper surface of the water-proof goggle frame portion 1 and the catching rib 3, to be elastically engaged therewith. With this arrangement, the joining strength between the water-proof frame portions 1 and the swimming cap 4 can be further improved, thus obtaining the effect similar to that in Embodiment 1.

Embodiment 3

The catching rib 3 of the water-proof frame portion 1 may be formed so as to be elastically deformed in the direction where the leading edge 4*a* of the swimming cap 4 is pressed between the water-proof goggle frame portion 1 and the same by an impulsive water pressure, thus obtaining the effect similar to that in Embodiment 1.

Although the present invention has been described hereinabove with reference to the preferred embodiments thereof, it is to be understood that the invention is not limited to such embodiments alone, and a variety of other modifications and variations will be apparent to those skilled in the art without departing from the spirit of the invention.

The scope of the invention, therefore, is to be determined solely by the appended claims.

What is claimed is:

1. A swimming instrument comprising:

swimming goggles including a pair of right and left water-proof goggle frame portions each of which is formed in a tapered cylinder shape, and lens portions each formed integrally with said water-proof goggle frame portions; and a swimming cap having leading edges each caught by said swimming goggles;

wherein said swimming goggles further comprises catching ribs for catching said leading edges of said swimming cap, said catching ribs being formed integrally with the surfaces of said water-proof goggle frame portions at positions higher than those of said lens portions; and said leading edge of said swimming cap being formed in a shape corresponding to that of said catching rib.

2. A swimming instrument according to claim 1, wherein each of said catching ribs of said swimming goggles is formed in a visor shape inclined downward along a tapered surface of said water-proof goggle frame portion with its base portion connected to the upper portion on the surface of said water-proof goggle frame portion.

3. A swimming instrument according to claim 1, wherein each of said catching ribs is formed in such a manner as to be elastically deformed where said leading edge of said swimming cap is pressed between said water-proof goggle frame portion and each of said elastically deformed catching ribs by an impulsive water pressure.

4. A swimming instrument according to claim 1, wherein said leading edge of said swimming cap elastically engages with a groove formed between the upper surface of said water-proof goggle frame portion and said catching rib.

5. Swimming goggles comprising:

a pair of right and left water-proof goggle frame portions each of which is formed in a tapered cylinder shape; and lens portions each formed integrally with said water-proof goggle frame portions;

wherein said swimming goggles further comprises catching ribs for catching leading edges of a swimming cap, said catching ribs each formed integrally with the surfaces of said water-proof goggle frame portions at positions higher than those of said lens portions.

6. Swimming goggles according to claim 5, each of said catching ribs of said swimming goggles is formed in a visor shape inclined downward along a tapered surface of said water-proof goggle frame portion with a base portion connected to an upper portion on a surface of said water-proof goggle frame portion.

7. Swimming goggles according to claim 5, wherein each of said catching ribs is formed in such a manner as to be elastically deformed where said leading edge of said swimming cap is pressed between said water-proof goggle frame portion and each of said elastically deformed catching ribs by an impulsive water pressure.

8. A swimming instrument according to claim 2, wherein each of said catching ribs is formed in such a manner as to be elastically deformed where said leading edge of said swimming cap is pressed between said water-proof goggle and each of said elastically deformed catching ribs by an impulsive water pressure.

9. A swimming instrument according to claim 2, wherein said leading edge of said swimming cap elastically engages with a groove formed between the upper surface of said water-proof goggle frame portion and said catching rib.

10. A swimming instrument according to claim 3, wherein said leading edge of said swimming cap elastically engages with a groove formed between the upper surface of said water-proof goggle frame portion and said catching rib.

11. A swimming instrument according to claim 8, wherein said leading edge of said swimming cap elastically engages with a groove formed between the upper surface of said water-proof goggle frame portion and said catching rib.

* * * * *